United States Patent [19]

Chu et al.

[11] 4,045,156

[45] Aug. 30, 1977

[54] PHOTOFLASH LAMP

[75] Inventors: Gordon P. K. Chu, Danvers; Dennis B. Shinn, Topsfield; John F. Waymouth, Marblehead, all of Mass.

[73] Assignee: GTE Sylvania Incorporated, Stamford, Conn.

[21] Appl. No.: 535,608

[22] Filed: Dec. 23, 1974

[51] Int. Cl.[2] ..... F21K 5/02

[52] U.S. Cl. ..... 431/95 R; 431/93

[58] Field of Search ..... 431/93–95, 431/95 A; 106/39.7; 220/2.1 R

[56] References Cited

U.S. PATENT DOCUMENTS

| | | | |
|---|---|---|---|
| 3,298,553 | 1/1967 | Lusher | 220/2.1 R |
| 3,463,647 | 8/1969 | Kosiorek et al. | 106/39.7 |
| 3,504,819 | 4/1970 | Veres | 220/2.1 R |
| 3,506,385 | 4/1970 | Weber et al. | 431/95 |
| 3,537,868 | 11/1970 | Kosaka | 106/39.7 |
| 3,723,790 | 3/1973 | Dumbaugh et al. | 431/95 |
| 3,788,865 | 1/1974 | Babcock et al. | 106/39.7 |
| 3,817,683 | 6/1974 | Weber | 431/93 |
| 3,832,124 | 8/1974 | Loughridge et al. | 431/93 |
| 3,885,182 | 5/1975 | Chu | 106/39.7 |

*Primary Examiner*—Carroll B. Dority, Jr.
*Attorney, Agent, or Firm*—Edward J. Coleman

[57] ABSTRACT

A photoflash lamp having an envelope composed of a crystallized glass which exhibits high refractoriness and mechanical strength and minimizes the propagation of flaws. The thermal expansion coefficient of the glass permits a match seal to commonly employed dumet wire leads.

11 Claims, 3 Drawing Figures

PHOTOFLASH LAMP

BACKGROUND OF THE INVENTION

This invention relates to photoflash lamps and, more particularly, to flashlamps containing a combustible material which is ignited to produce actinic light.

A typical photoflash lamp comprises an hermetically sealed glass envelope containing a quantity of combustible metal, such as shredded zirconium or hafnium foil, and a combustion-supporting gas, such as oxygen, at a pressure well above one atmosphere. In lamps intended for battery operated flash systems, the envelope also includes an electrical ignition system comprising a tungsten filament supported on a pair of lead-in wires having a quantity of ignition paste on the inner ends thereof adjacent to the filament. This type of lamp is operated by the passage of an electrical current through the lead-in wires which incandesces the filament to ignite the ignition paste which in turn ignites the combustible metal in the envelope. In the case of percussive-type photoflash lamps, such as described in U.S. Pat. No. 3,535,063, a mechanical primer is sealed in one end of the lamp envelope. The primer may comprise a metal tube extending from the lamp envelope and a charge of fulminating material on an anvil wire supported in the tube. Operation of the percussive photoflash lamp is initiated by an impact onto the tube to cause deflagration of the fulminating material up through the tube to ignite the combustible metal disposed in the lamp envelopes.

Typically, the flashlamp envelope is comprised of G-1 type soft glass having a coefficient of thermal expansion within the range of 85 to 95 $\times 10^{-7}$in./in./° C between 20° C and 300° C, and the metal from which the primer tube is formed or the lead-in wires are made has a similar coefficient of thermal expansion so as to provide a match seal.

During lamp flashing, the glass envelope is subject to severe thermal shock due to hot globules of metal oxide and/or molten metal impinging on the walls of the lamp. As a result, cracks and crazes occur in the glass and, at higher internal pressures, containment failure becomes possible. In order to reinforce the glass envelope and improve its containment capability, it has been common practice to apply a protective lacquer coating on the lamp envelope by means of a dip process. To build up the desired coating thickness, the glass envelope is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

In the continuing effort to improve light output, higher performance flashlamps have been developed which contain higher combustible fill weights per unit of internal envelope volume, along with higher fill gas pressures. In addition, the combustible material may be one of the hotter burning types, such as hafnium. Such lamps, upon flashing, appear to subject the glass envelopes to more intense thermal shock effects, and thus require stronger containment vessels. One approach to this problem has been to employ a hard glass envelope, such as the borosilicate glass envelope described in U.S. Pat. No. 3,506,385, along with a protective dip coating of cellulose acetate. More specifically, the patent describes an electrically ignitable lamp having in-leads of a metal alloy such as Rodar or Kovar secured by an internal expansion match seal in a glass envelope having a coefficient of thermal expansion in the range of 40 to 50 $\times 10^{-7}$ in./in./° C. Type 7052 glass is mentioned as typical. The patent imposes a minimum of 40 $\times 10^{-7}$in./in./° C. on the coefficient of thermal expansion of the glass to assure the necessary match seal with the Rodar or Kovar in-leads. Further, it is theorized that glass in this thermal expansion range provides a more beneficial mode of fracture which results in a delay of crack time after flashing. More specifically, fracture of the glass is delayed to a time when the pressure in the lamp has been reduced to a point where containment is more readily assured. On the other hand, the use of hard glass incurs considerable added expense over the more commonly used soft glass due to both increased material cost and the need for special lead-in wires or primer tubes (e.g., Rodar or Kovar) to provide sealing compatibility with the low thermal expansion hard glass envelope. In addition, even though more resistant to thermal shock, hard glass envelopes do not eliminate fracture and often exhibit cracks and crazes upon lamp flashing.

SUMMARY OF THE INVENTION

In view of the foregoing, it is an object of the present invention to provide a photoflash lamp having an improved containment vessel.

A principal object of the invention is to provide a photoflash lamp having a significantly stronger envelope which permits conventional glass-to-metal match seals with commonly used lead-in wire and primer tube materials.

These and other objects, advantages and features are attained, in accordance with the invention, by providing a lamp envelope formed of a crystallized glass, whereby the relatively high refractoriness and strength of the crystallized glass render the envelope and its internal surface particularly resistant to the thermal shock and mechanical stress resulting from the impingement of hot combustion residues upon flashing of the lamp. In addition, the finely divided crystallized structure and the glass-crystal interfacial grain boundaries in the crystallized glass minimize the propagation of cracks through the thickness of the envelope. The total light transmission of the crystallized glass is at least about 80 percent, and the mean coefficient of thermal expansion of the crystallized glass envelope lies within a range of 80 to 95 $\times 10^{-7}$in./in./° C between 0° C and 300° C. Accordingly, a compatible match seal may be made with the dumet wire inleads or primer tube metals commonly employed with soft glass envelopes.

The previously referenced U.S. Pat. No. 3,506,385 describes a photoflash lamp having an envelope of borosilicate glass selected so that a substantial mode of fracture of the glass envelope on flashing of the lamp is by spalling off or "shaling" of layers of parts of the internal surface of the glass envelope at the loci of impingement of combustion residues, thereby minimizing and delaying the formation and propagation of cracks into and penetrating through the thickness of the glass envelope. In contrast, the crystallized glass envelope, of a photoflash lamp in accordance with the present invention, exhibits a surprisingly different mode of thermal-mechanical impact response. There appears to be no spalling or shaling and, in fact, little or no crack propagation. Indeed, upon examining by optical microscopy a portion of the crystallized glass envelope of a hafnium-filled photoflash lamp subsequent to ignition, the interior glass surface upon which myriad $HfO_2$ molten droplets had impinged during the high pressure actinic raction exhibited only localized minor damage with little or no line of fracture or propagation of cracks. A similar post-ignition examination under a microscope of a flashlamp envelope formed of Corning type 7064 borosilicate hard glass (which is similar to 7052 glass) revealed parallel patterns of severe fractures which had propagated near the peripheries of the molten droplets of $HfO_2$. In both of the above cases the original flashlamp envelope had an internal volume of about 0.35 cc and contained about 25 mgs. of shredded hafnium foil at a fill pressure of a little over 12 atmospheres. Microscopic examination of Corning type G-1 lead glass (soft glass) from a flashed zirconium filled lamp revealed that severe fracture lines easily propagated around the peripheries of the molten droplets.

We have found that the relatively high refractories of a crystallized glass envelope provides the observed high resistance to melting and damage from the impingement of molten droplets and other combustion residues in a flashed lamp. Accordingly, we prefer to select a crystallized glass having a softening point near or above 750° C. Further, as discussed in more detail hereinafter, it appears that the crystalline grain structure of the crystallized glass significantly minimizes flaw propagation, for which purpose we prefer to maintain the grain size in a range of about 0.05 to 10 microns.

In addition to the advantages of significantly improved containment flowing from the unique mode of thermal-mechanical impact response exhibited by the use of crystallized glass as a flashlamp envelope, the present invention permits the practical and safe use of even smaller flashlamp envelope sizes with higher loadings to provide high light output intensities. For example, such lamps may contain shredded zirconium or hafnium combustible fills of at least 25 millimoles per milliliter of lamp volume and oxygen pressures in excess of ten atmospheres.

BRIEF DESCRIPTION OF THE DRAWINGS

This invention will be more fully described hereinafter in conjunction with the accompanying drawings, in which.

DESCRIPTION OF PREFERRED EMBODIMENT

The teachings of the present invention are applicable to either percussive or electrically ignited photoflash lamps of a wide variety of sizes and shapes. Accordingly, FIGS. 1 and 2 respectively illustrate electrically ignited and percussive-type photoflash lamps embodying the principles of the invention.

Figure 1:
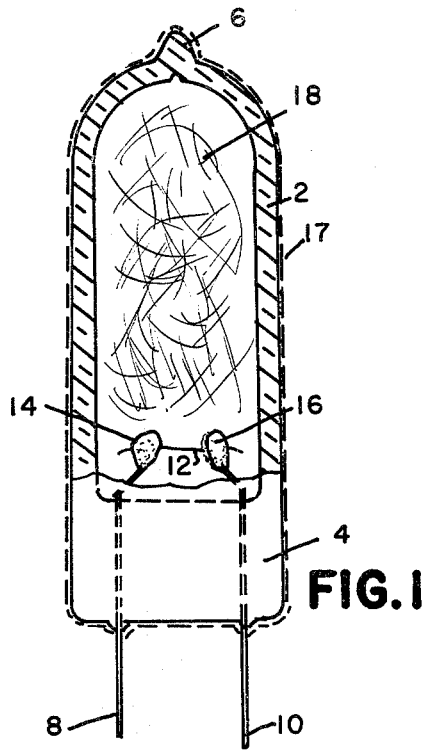
FIG. 1 is an enlarged elevational view, partly in section, of an electrically ignitable photoflash lamp having an envelope of crystallized glass in accordance with the invention.

Referring to FIG. 1, the electrically ignitable lamp comprises an hermetically sealed, light-transmitting lamp envelope 2 of crystallized glass tubing having a press 4 defining one end thereof and an exhaust tip 6 defining the other end thereof. Supported by the press 4 is an ignition means comprising a pair of lead-in wires 8 and 10 extending through and sealed into the press. Both the crystallized glass envelope 2 and the lead-in wires 8 and 10 have mean coefficients of thermal expansion in the range of about 80 to 95 $\times 10^{-7}$in./in./° C between 0° C and 300° C. A filament 12 spans the inner ends of the lead-in wires, and beads of primer 14 and 16 are located on the inner ends of the lead-in wires 8 and 10 respectively at their junctions with the filament. Typically, the lamp envelope 2 has an internal diameter of less than one-half inch, and an internal volume of less than 1 cc., although the present invention is equally suitable for application to larger lamp sizes. The exterior surface of the glass envelope is covered with a protective coating 17 (denoted by dashed lines) such as cellulose acetate lacquer or a vacuum-formed thermoplastic coating, such as described in U.S . Pat. No. 3,770,366. A combustion-supporting gas, such as oxygen, and a filamentary combustible metal 18, such as shredded zirconium or hafnium foil, are disposed within the lamp envelope. Typically, the combustion-supporting gas fill is at a pressure exceeding about 500 centimeters of mercury, and the lamp is loaded with at least about 18 milligrams of the filamentary combustible metal.

Figure 2:
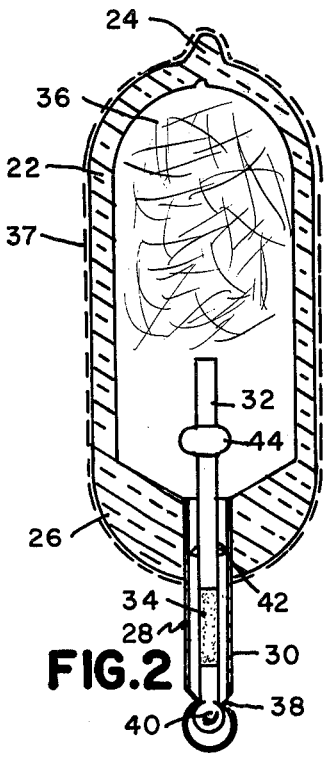
FIG. 2 is an enlarged sectional elevation of a percussive-type photoflash lamp having an envelope of crystallized glass in accordance with the invention.

The percussive-photoflash lamp illustrated in FIG. 2 comprises a length of light-transmitting tubing defining an hermetically sealed lamp envelope 22 constricted at one end to define an exhaust tip 24 and shaped to define a match seal 26 about a primer 28 at the other end thereof. Again, in accordance with the invention, envelope 22 comprises a crystallized glass. The primer 28 comprises a metal tube 30, a wire anvil 32, and a charge of fulminating material 34. A combustible metal 36, such as filamentary zirconium or hafnium, and a combustion-supporting gas, such as oxygen, are disposed within the lamp envelope with the fill gas typically being at a pressure of greater than about 500 cm. Hg. and the quantity of combustible metal fill being at least about 18 mgs. The exterior surface of the glass envelope is covered with a protective coating 37, such as cellulose acetate lacquer or a vacuum-formed thermoplastic. Both the crystallized glass envelope 22 and the metal primer tube 30 have mean coefficients of the thermal expansion in the range of about 80 to 95 $\times 10^{-7}$in./in./° C between 0° C and 300° C.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A refractory or metal bead 44 is located on the wire anvil 32 just above the inner mouth of the primer tube 30 to eliminate tube 30 burn-through and function as a deflector to deflect and control the ejection of hot gases from the fulminating material in the primer. The lamp of FIG. 2 is also typically a subminiature type having envelope dimensions similar to those described with respect to FIG. 1.

Although the lamp of FIG. 1 is electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible metal 18 or 36. More specifically, the igniter filament 12 of the flash lamp in FIG. 1 is incandesced electrically by current passing through the metal filament support leads 8 and 10, whereupon the incandescent filament 12 ignites the beads of primer 14 and 16 which in turn ignite the combustible metal 18 disposed within the lamp envelope. Operation of the percussive-type lamp of FIG. 2 is initiated by an impact onto tube 30 to cause deflagration of the fulminating material 34 up through the tube 30 to ignite the combustible metal 36 disposed within the lamp envelope.

Ignition of the filamentary combustible metal 18 or 36 produces an array of burning droplets of metal and metal oxide which impinge against the envelope walls. The typical droplet radius is from 50–100 microns. Pursuant to extensive experimentation, we have closely studied the kinetics of combustion involved in the collision of such droplets with a variety of wall materials. To our surprise, we discovered that crystallized glasses can transmit a suitable efficient amount of light through the lamp envelope, yet possess unusual properties of the envelope whereby it is mechanically strong and hard, and thermally resistant to high temperature shock. More specifically, we have observed a unique mode of thermal-mechanical impact response during and immediately after the combustion process, whereby impingement by the molten droplets of zirconium or hafnium upon ignition will cause little or no damage to the crystallized glass envelopes. The mode of fracture, if any, occuring is quite different from that of ordinary lead glass or the borosilicate glasses, since the crystallites are developed upon a controlled heat treatment through which the interwoven fine crystallites are dispersed uniformly in a glass matrix which has been transformed into a much more refractory glass as compared to the original glass before crystallization.

A number of crystallizable glass compositions may be suitable for this application. For example, the following composition ranges, by weight, are suitable for the crystallized glass envelope 2 and 22 of the photoflash lamps of FIGS. 1 and 2:

| | |
|---|---|
| $Li_2O$ | 8 to 20% |
| $Na_2O$ and/or $K_2O$ | 1 to 7% |
| $SiO_2$ | 45 to 72% |
| $Al_2O_3$ | 4 to 20% |
| CaO and/or SrO and/or BaO and/or MgO | 0.6 to 7% |
| $B_2O_3$ | 1 to 4% |
| $As_2O_3$ and/or $Sb_2O_3$ and/or $P_2O_5$ and/or $MoO_3$ | 2 to 7% |

The nucleation and crystallization temperatures of these glasses are about 520° C and 800° C, respectively, and may be modified within a narrow range about these temperatures. This means that if glass tubing is formed directly from the hot glass melt, the tubing must be cooled to the nucleation temperature, or preferably below that temperature, before it is reheated to the crystallization temperatures. The nucleation and crystallization processes change the glass from transparent to translucent, but having high total light transmission, i.e. greater than 80 percent.

In one specific embodiment of the invention, an electrical flashlamp of the type shown in FIG. 1 was provided with a crystallized glass envelope 2 formed from tubing produced as described below from the following glass composition, by weight, which we have designated Sylvania Type D-31 glass:

| | |
|---|---|
| $Li_2O$ | 13.48% |
| $Na_2O$ | 1.04% |
| $K_2O$ | 4.05% |
| $SiO_2$ | 70.71% |
| $Al_2O_3$ | 6.10% |
| CaO | 0.52% |
| MgO | 0.18% |
| $B_2O_3$ | 1.02% |
| $P_2O_5$ | 2.90% |

The raw materials providing these oxide ingredients were mixed and heated in a refractory tank or container at 1350° to 1400° C for 3 to 8 hours to form uniformly melted glass from which tubing was formed having a nominal outside diameter of about 0.259 inch and an inside diameter of about 0.200 inch. At this stage the glass tubing was transparent, having a light transmission of about 99%. The glass tubing was then nucleated and crystallized by heating under a controlled schedule at a rate of 5° to 30° C per minute depending upon thickness and size. In order to obtain uniform finely dispersed nucleation and crystallization, the heat treatment was carried out in two stages. First, the envelopes were maintained at a temperature of 500°–565° C for about 10 minutes. This first stage crystallization temperature range is about 50° C above the lower annealing temperature (475°–500° C) of the glass. The heating was then continued to a temperature of 750°–785° C which was maintained for another 10 minutes. This second stage crystallization yields more complete crystallization. This process yielded translucent tubing (and subsequently envelopes) having a light transmission of about 95%. More extensive crystallization could be obtained, for example, by more extensive second stage crystallization, such as at 770°–800° C for 20 minutes or longer. This yields a translucent tubing having a light transmission of about 92%.

After the tubing was crystallized, it was still sufficiently workable so that it could be formed into the lamp envelope 2 and provide a matched press seal 4 with dumet wire inleads 8 and 10.

The lamp formed from this crystallized glass tubing contained a combustible fill comprising about 25 mgs. of shredded hafnium foil and oxygen at a fill pressure of about 12.8 atmospheres. The tubular envelope 2 had a nominal outside diameter of 0.259 inch, a wall thickness of about 0.030 inch, an overall outside length of about 0.980 inch, and an internal volume of about 0.35 cc. The outside surface of the envelope was coated with about four layers of cellulose acetate 17, to provide an overall outside diameter of about 0.280 inch. The inleads 8 and 10 were formed of dumet wire having a diameter of about 14 mils and extended through the conventional press seal 4 to the inside of the lamp for supporting the tungsten filament 12 and primer beads 14 and 16.

Figure 3:
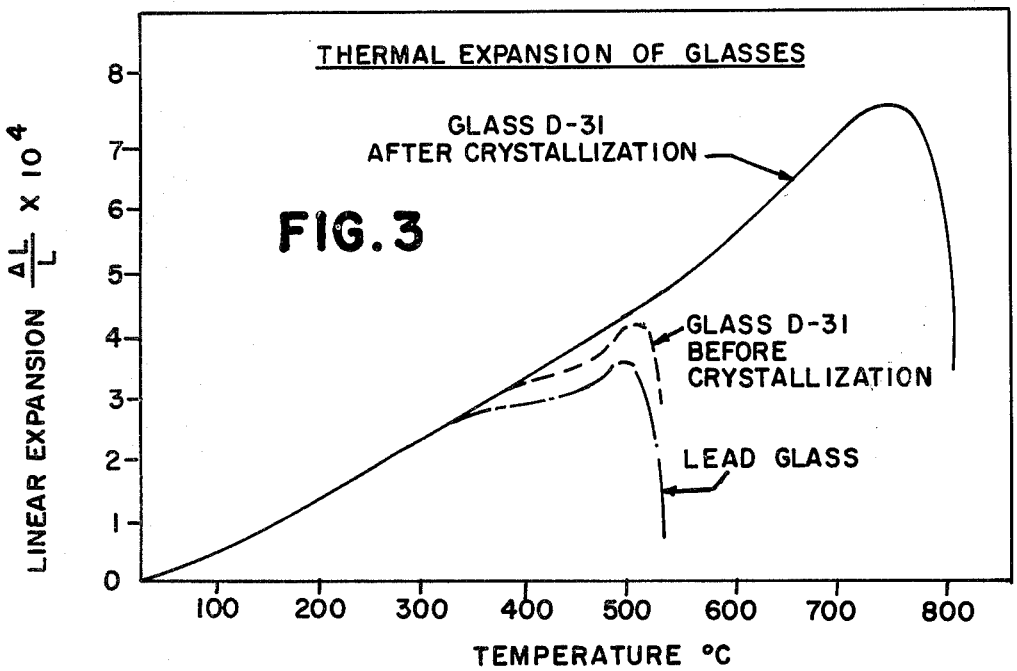
FIG. 3 shows comparative thermal expansion curves of a glass composition according to the invention before and after crystallization along with the curve of a commercial lead glass widely used for photoflash lamps.

The thermal expansion curves of the D-31 glass before and after crystallization are shown in FIG. 3, together with the curve of a commercial lead glass (Corning G-1) which has been widely used for photoflash lamps. It will be particularly noted that the crystallized glass curve substantially matches the thermal expansion characteristic of the soft lead glass up to the softening point of the latter, yet the refractoriness of the D-31 glass has been greatly increased as shown by the raising of the dilatometer softening point from 495° C to about 755° C after crystallization. This increase of refractoriness greatly improves the material to resist the high temperature impingement of the molten droplets of burned zirconium or hafnium shreds.

In addition, our studies have revealed that this type of crystallized glass is much harder than ordinary commercial glasses. For example, the D-31 crystallized glass has been found to have a Diamond Pyramid Hardness Number (DPN) in the range of 700 to 900, depending on the extent of the crystallization treatment, whereas the DPN hardness of ordinary commercial glasses (such as lead, lime or borosilicate) is in the range of 400 to 600. Accordingly, the crystallized glass is much more scratch resistant and relatively insensitive to flaws or notches. Therefore, in practical service, the strength of the crystallized glass is generally several times higher than that of ordinary glasses, which are generally weakened due to their inherent flaw sensitivity and surface imperfections.

When the present type of crystallized glass is used for photoflash lamp envelopes, the containment strength far exceeds that of lamp envelopes made from either soft lead-containing or hard borosilicate glasses. Moreover, as illustrated by the curves of FIG. 3, the present crystallized glass is also suitable for providing matched glass-to-metal seals with the same inlead or primer tube materials as conventional soft glass. In the above example, the mean coefficient of thermal expansion of the D-31 glass is about 87 to 93 $\times 10^{-7}$in./in./° C between 0° C and 300° C, while the radial coefficient of thermal expansion of the dumet wire inleads is about 90 $\times 10^{-7}$in./in./° C between 25° C and 400° C.

Moreover, as is generally known, ordinary glasses are very susceptible to breakage due to flaw, or crack propagation, particularly from the surface of the glass. The transformation of the original glass to partially crystallized material, however, has greatly reduced the sensitivity of flaw propagation. More specifically, the stresses resulting from either thermal or mechanical abuse appear to be "dampened" by the interlocked crystallites. The stress is dissipated toward the crystalline-grain boundaries so that the damage done, if any, is limited to a very localized area perhaps a few crystallites in depth. As a result, the ordinary crack propagation of glass is eliminated. As previously observed, these damage and crack propagation effects have been observed by microscopic examination of various lamp envelopes after flashing.

Although the invention has been described with respect to specific embodiments, it will be appreciated that modifications and changes may be made by those skilled in the art without departing from the true spirit and scope of the invention.

What we claim is:

1. A photoflash lamp comprising:
an hermetically sealed, light-transmitting envelope;
a quantity of combustible material located in said envelope;
a combustion-supporting gas in said envelope; and
ignition means attached to said envelope and disposed in operative relationship to said combustible material;
said envelope comprising a light-transmitting wall of uniformly crystallized glass having a mean coefficient of thermal expansion in the range of about 80 to 95 $\times 10^{-7}$in./in./° C between 0° C and 300° C, whereby
the relatively high refractoriness and strength of said crystallized glass wall render said envelope and the internal surface of said envelope particularly resistant to the thermal shock and mechanical stress resulting from the impingement of hot combustion residues upon flashing of said lamp, and the glass-crystal interfacial grain boundaries in said crystallized glass minimize the propagation of cracks through the thickness of said envelope.

2. The lamp of claim 1 wherein the total light transmission of said crystallized glass envelope is at least about 80 percent.

3. The lamp of claim 1 wherein the grain size of said crystallized glass is about in the range of 0.05 to 10 microns, whereby flaw propagation is minimized.

4. The lamp of claim 1 wherein the softening point of said crystallized glass is near or above 750° C.

5. The lamp of claim 1 wherein the internal volume of said envelope is less than about one cubic centimeter, said combustible material is filamentary, the weight of said quantity of filamentary material is at least about 18 milligrams, and the fill pressure of said combustion-supporting gas is greater than about 500 centimeters of mercury.

6. The lamp of claim 1 wherein the crystallized glass of said envelope has a composition consisting essentially of the following constituents in about the ranges stated by weight:

| | |
|---|---|
| $Li_2O$ | 8 to 20% |
| $Na_2O$ and/or $K_2O$ | 1 to 7% |
| $SiO_2$ | 45 to 72% |
| $Al_2O_3$ | 4 to 20% |
| CaO and/or SrO and/or BaO and/or MgO | 0.6 to 7% |
| $B_2O_3$ | 1 to 4% |
| $As_2O_3$ and/or $Sb_2O_3$ and/or $P_2O_5$ and/or $MoO_3$ | 2 to 7%. |

7. The lamp of claim 6 wherein the softening point of said crystallized glass is near or above 750° C.

8. The lamp of claim 7 wherein said ignition means includes at least one metallic member depending from said glass envelope, and both said crystallized glass envelope and said metallic member have mean coefficients of thermal expansion in the range of about 80 to 95 $\times 10^{-7}$in./in./° C between 0° C and 300° C, whereby said metallic member is attached to said envelope by a substantially matched seal.

9. The lamp of claim 8 wherein said lamp is a percussive type, and said ignition means comprises a primer secured to and extending from one end of said envelope and in communication therewith, said primer including a metal tube sealed in said end of said envelope and having an exposed segment outside said envelope, and a body of fulminating material located in the exposed segment of said tube, said metal tube being said metallic member.

10. The lamp of claim 8 wherein said ignition means includes a pair of lead-in wires sealed through one end of said envelope and extending inside said envelope, and a filament disposed within said envelope and attached to said lead-in wires, said lead-in wires being said metallic member.

11. The lamp of claim 10 wherein the internal volume of said envelope is less than about one cubic centimeter, said combustible material is filamentary, the weight of said filamentary material per unit of envelope volume is greater than about 25 millimoles per milliliter, and the fill pressure of said combustion-supporting gas is greater than about 10 atmospheres.

* * * * *